US008656745B2

(12) United States Patent
Kim et al.

(10) Patent No.: US 8,656,745 B2
(45) Date of Patent: Feb. 25, 2014

(54) WASHING MACHINE

(75) Inventors: Sung Ryong Kim, Seoul (KR); Na Eun Kim, Seoul (KR); Dong Won Kim, Seoul (KR); Young Min Kim, Seoul (KR); Cheol Soo Ko, Seoul (KR); Hea Kyung Yoo, Seoul (KR); Dong Soo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 987 days.

(21) Appl. No.: 12/709,751

(22) Filed: Feb. 22, 2010

(65) Prior Publication Data

US 2010/0212367 A1 Aug. 26, 2010

(30) Foreign Application Priority Data

Feb. 23, 2009 (KR) ..... 10-2009-0014825
Mar. 3, 2009 (KR) ..... 10-2009-0017941

(51) Int. Cl.
*D06F 35/00* (2006.01)

(52) U.S. Cl.
USPC ..... 68/20

(58) Field of Classification Search
USPC ..... 68/3 R, 19.1, 20; 34/76, 77, 596, 604, 34/607
See application file for complete search history.

(56) References Cited

U.S. PATENT DOCUMENTS 2,334,025 A 11/1943 O'Neill
2,351,429 A 6/1944 Huebsch
2,566,488 A 9/1951 Gould
2,677,897 A 5/1954 Herbster
2,755,072 A 7/1956 Kreuttner
2,830,385 A 4/1958 Smith
2,943,473 A * 7/1960 Worst ..... 68/12.15
3,064,358 A 11/1962 Giuffre
3,636,735 A * 1/1972 Borochaner ..... 68/12.18
4,292,744 A 10/1981 Nabholz
4,603,489 A 8/1986 Goldberg
4,621,438 A 11/1986 Lanciaux
5,174,467 A 12/1992 Sullivan (Continued)

FOREIGN PATENT DOCUMENTS

CN 1542208 11/2004
CN 2680709 2/2005

(Continued)

OTHER PUBLICATIONS

Machine translation of KR 10-2007-0082377, no date.*

(Continued)

*Primary Examiner* — Joseph L Perrin
(74) *Attorney, Agent, or Firm* — Ked & Associates, LLP

(57) ABSTRACT

A washing machine is provided that is capable of efficiently draining condensed fluid discharged by a heat pump module. The washing machine may include a first cabinet, a tub installed in the first cabinet, a drum rotatably installed in the tub, a second cabinet detachably coupled to the first cabinet, a heat pump module mounted in the second cabinet so as to supply hot air into the drum, a condensed fluid drain pump that pumps condensed fluid generated by the heat pump module, and a condensed fluid drain hose, one end of which is connected to the condensed fluid drain pump and the other end of which is connected to the tub, to discharge the condensed fluid pumped by the condensed fluid drain pump to the inside of the tub.

8 Claims, 11 Drawing Sheets

(56) References Cited

U.S. PATENT DOCUMENTS

| | | | | |
|---|---|---|---|---|
| 5,343,632 | A | 9/1994 | Dinh | |
| 5,392,613 | A | 2/1995 | Bolton et al. | |
| 5,640,783 | A | 6/1997 | Schumaier | |
| 5,664,430 | A | 9/1997 | Karman | |
| 5,689,962 | A | 11/1997 | Rafalovich | |
| 5,697,227 | A | 12/1997 | Bruce et al. | |
| 5,732,562 | A | 3/1998 | Moratalla | |
| 5,732,565 | A | 3/1998 | Ramakrishnan et al. | |
| 5,787,721 | A | 8/1998 | Fromm et al. | |
| 5,806,207 | A | 9/1998 | Merrigan | |
| 5,901,566 | A | 5/1999 | Macosko et al. | |
| 6,085,539 | A | 7/2000 | Meyer | |
| 6,098,310 | A | 8/2000 | Chen et al. | |
| 6,471,739 | B2 | 10/2002 | Eom | |
| 6,701,739 | B2 | 3/2004 | Morse | |
| 7,055,262 | B2 | 6/2006 | Goldberg et al. | |
| 7,165,416 | B2 | 1/2007 | Lee et al. | |
| 7,168,274 | B2 | 1/2007 | Slutsky et al. | |
| 7,174,741 | B2 | 2/2007 | Lee et al. | |
| 7,213,407 | B2 | 5/2007 | Hu | |
| 7,263,852 | B2 | 9/2007 | Bacchus | |
| 7,284,388 | B2 | 10/2007 | Yoshida | |
| 7,325,333 | B2 | 2/2008 | Tadano et al. | |
| 7,409,776 | B2 | 8/2008 | Ono et al. | |
| 7,418,826 | B2 | 9/2008 | Rios et al. | |
| 7,430,877 | B2 | 10/2008 | Davenport et al. | |
| 7,469,486 | B2 | 12/2008 | Tamura et al. | |
| 7,694,434 | B2 | 4/2010 | Lee | |
| 7,866,061 | B2 | 1/2011 | Tatsumi et al. | |
| 7,908,766 | B2 | 3/2011 | Ahn et al. | |
| 7,950,245 | B2 | 5/2011 | Lee et al. | |
| 7,975,502 | B2 | 7/2011 | Tamura et al. | |
| 7,984,568 | B2 | 7/2011 | Dittmer et al. | |
| 8,037,707 | B2 | 10/2011 | Lee et al. | |
| 8,056,351 | B2 | 11/2011 | Marciano et al. | |
| 8,079,157 | B2 | 12/2011 | Balerdi Azpilicueta et al. | |
| 8,171,748 | B2 | 5/2012 | Ooishi et al. | |
| 2004/0079121 | A1 | 4/2004 | Yabuuchi et al. | |
| 2004/0182100 | A1 | 9/2004 | Lee et al. | |
| 2005/0198851 | A1* | 9/2005 | Tomochika et al. | 34/74 |
| 2005/0204755 | A1 | 9/2005 | Nishiwaki et al. | |
| 2006/0191289 | A1 | 8/2006 | Bush et al. | |
| 2006/0218976 | A1 | 10/2006 | Lee et al. | |
| 2006/0263501 | A1 | 11/2006 | Oghafua et al. | |
| 2007/0095111 | A1* | 5/2007 | Watkins et al. | 68/140 |
| 2007/0113574 | A1 | 5/2007 | Davenport et al. | |
| 2007/0134522 | A1 | 6/2007 | Ko et al. | |
| 2008/0000253 | A1 | 1/2008 | Kim et al. | |
| 2008/0223084 | A1* | 9/2008 | Kuwabara | 68/20 |
| 2009/0013730 | A1* | 1/2009 | Woo et al. | 68/23.1 |
| 2010/0077787 | A1 | 4/2010 | Masuda et al. | |
| 2010/0107703 | A1* | 5/2010 | Hisano et al. | 68/20 |
| 2010/0180621 | A1 | 7/2010 | Lee et al. | |
| 2010/0326116 | A1 | 12/2010 | Kwon | |

FOREIGN PATENT DOCUMENTS

| | | | |
|---|---|---|---|
| CN | 1667177 | | 9/2005 |
| CN | 1695029 | | 11/2005 |
| CN | 1966844 | | 5/2007 |
| CN | 101122405 | | 2/2008 |
| CN | 101122410 | | 2/2008 |
| CN | 101135101 | | 3/2008 |
| CN | 101139791 | | 3/2008 |
| CN | 101153456 | | 4/2008 |
| CN | 101173478 | | 5/2008 |
| CN | 101187140 | | 5/2008 |
| CN | 101348989 | | 1/2009 |
| DE | 42 12 700 | | 10/1993 |
| EP | 0 943 721 | | 9/1999 |
| EP | 1 634 984 | | 3/2006 |
| EP | 1 726 703 | | 11/2006 |
| GB | 2 289 752 | | 11/1995 |
| JP | 59-085694 | | 5/1984 |
| JP | 2001-212599 | | 8/1989 |
| JP | 02-029296 | | 1/1990 |
| JP | 05-049795 | | 3/1993 |
| JP | 2001-198398 | | 7/2001 |
| JP | 2006-110394 | | 4/2006 |
| JP | 2006-345919 | | 12/2006 |
| JP | 2007-127326 | | 5/2007 |
| JP | 2007-175528 | | 7/2007 |
| JP | 2007-330439 | | 12/2007 |
| JP | 2007-330571 | | 12/2007 |
| JP | 2008-000226 | | 1/2008 |
| JP | 2008-006127 | | 1/2008 |
| JP | 2008-48830 | | 3/2008 |
| KR | 10-2006-0052284 | | 5/2006 |
| KR | 1020070082377 | A * | 8/2007 |
| KR | 10-2008-0056007 | | 6/2008 |
| WO | WO 2005/090669 | | 9/2005 |
| WO | WO 2006/009364 | | 1/2006 |
| WO | WO 2006/097901 | | 9/2006 |

OTHER PUBLICATIONS

Machine translation of JP 2006-345919, no date.*

International Search Report and Written Opinion issued in PCT/KR2010/000487 dated Apr. 13, 2010.

Chinese Office Action issued in CN Appln. No. 201080005041.X dated Aug. 13, 2012 (full English text and full Chinese text).

Chinese Office Action issued in CN Appln. No. 201080004986.X dated Aug. 13, 2012 (full English text and full Chinese text).

Chinese Office Action issued in CN Appln. No. 2010-80005040.5 dated Aug. 14, 2012 (full English text and full Chinese text).

Chinese Office Action issued in CN Appln. No. 2010-800050425042.4 dated Aug. 28, 2012 (full English text and full Chinese text).

U.S. Office Action issued in U.S. Appl. No. 12/709,816 dated Oct. 22, 2012.

International Search Report and Written Opinion issued in PCT Application No. PCT/KR2010/001317 dated Oct. 11, 2010.

International Search Report and Written Opinion issued in PCT Application No. PCT/KR2010/000713 dated Oct. 19, 2010.

European Search Report issued in EP Application No. 10738756.5 dated Nov. 16, 2012.

Chinese Office Action issued in CN Application No. 2010-80005766 dated Nov. 26, 2012 (Full English translation and full Chinese text).

International Search Report and Written Opinion issued in PCT/KR2010/000867 dated Aug. 2, 2010.

U.S. Office Action issued in U.S. Appl. No. 12/700,190 dated Jun. 29, 2012.

U.S. Office Action issued in U.S. Appl. No. 12/700,176 dated Jul. 2, 2012.

* cited by examiner

WASHING MACHINE

This application claims the benefit of the Korean Patent Application No. 10-2009-0017941, filed in Korea on Mar. 3, 2009, and Korean Patent Application No. 10-2009-0014825, filed in Korea on Feb. 23, 2009, which are both hereby incorporated by reference as if fully set forth herein.

BACKGROUND

1. Field

A washing machine having a heat module is provided.

2. Background

Recently developed washing machines may provide a drying function in addition to washing, rinsing, and spin-drying functions. Such a washing machine may include a heater or a heat pump module to generate hot air to dry laundry. However, such a washing machine may generate unpleasant odors due to stagnation of condensed fluid.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to embodiments, examples of which are illustrated in the accompanying drawings. Wherever possible, the same reference numbers will be used throughout the drawings to refer to the same or like parts.

Figure 1:
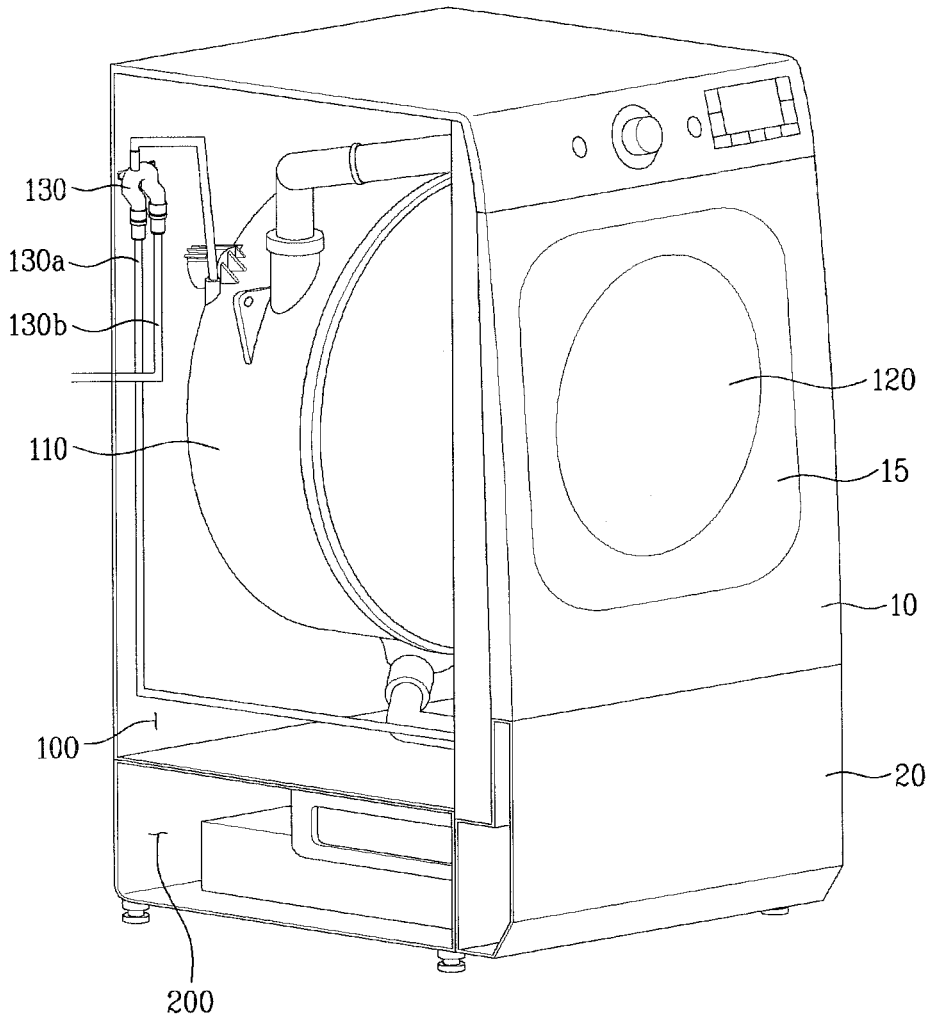
FIG. 1 is a perspective view of a washing machine according to an embodiment as broadly described herein.
Figure 2:
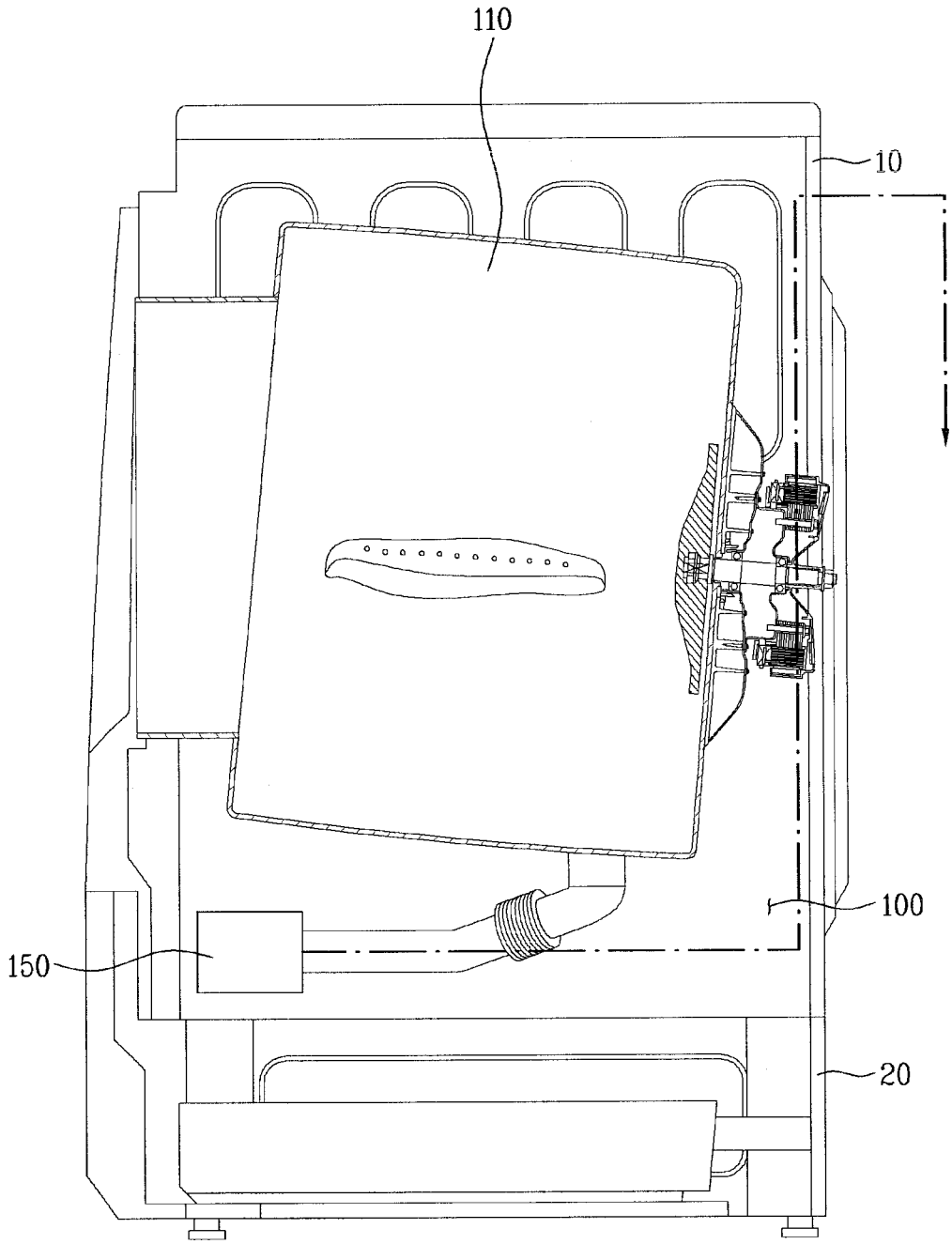
FIG. 2 is a sectional view of the washing machine of FIG. 1, showing the drainage flow of wash fluid.
Figure 3:
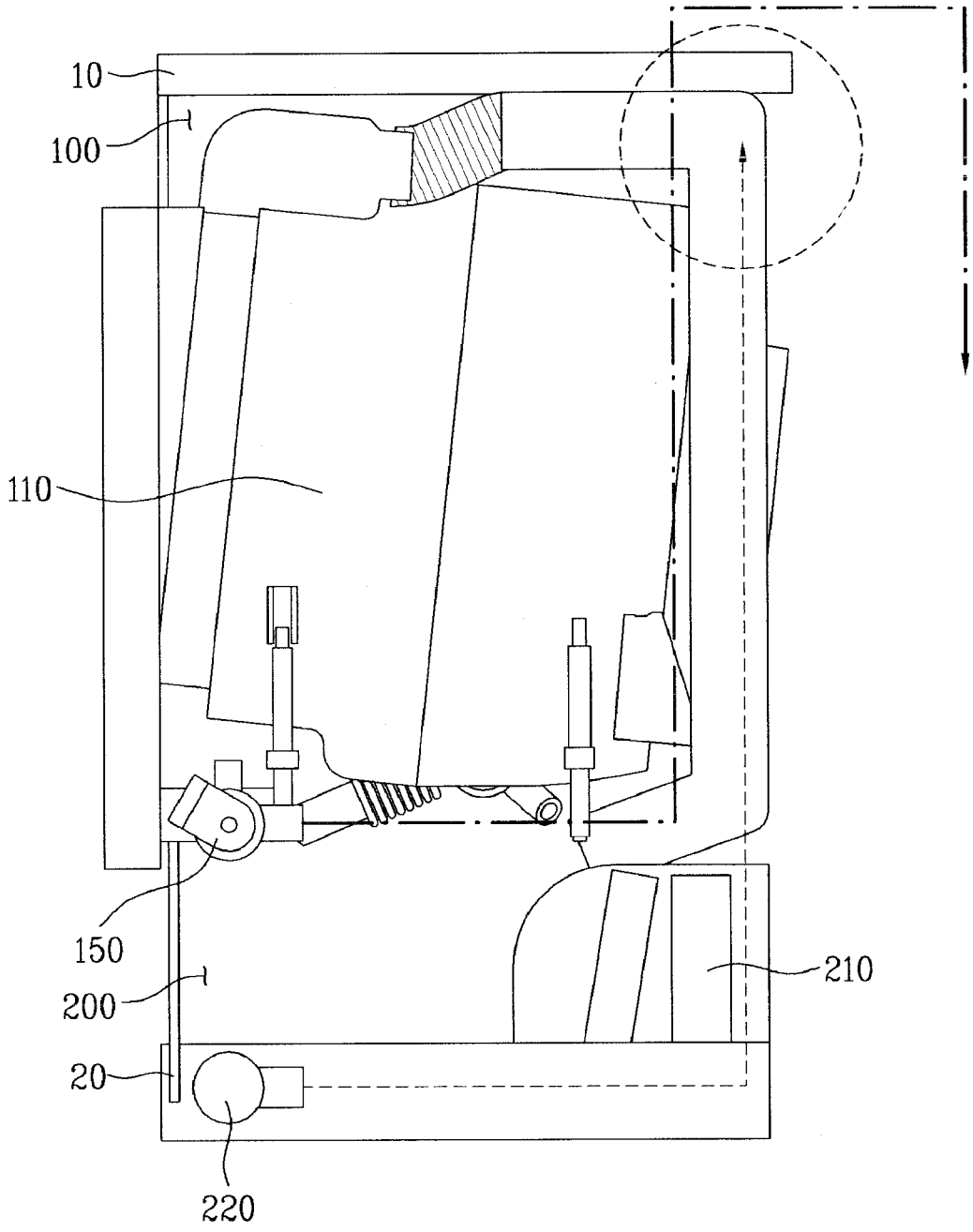
FIG. 3 is a sectional view of the washing machine of FIG. 1, showing the drainage flow of condensed fluid.

Referring to FIG. 1 to FIG. 3, a washing machine according to an embodiment as broadly described herein may include a first cabinet 10 that forms a first space 100, a door 15 that opens and closes an opening formed on a front of the first cabinet 10, and a tub 110 installed in the first cabinet 10. A drum 120 is rotatably coupled to the inside of the tub 110 to receive laundry items therein. A second cabinet 20 may be detachably connected to a lower part of the first cabinet 10, thereby forming a second space 200.

The second cabinet 20 may house a heat pump module 210 that supplies hot air for drying laundry, and an inlet duct that guides air into the heat pump module 210. The second cabinet 20 may also include an outlet duct that guides the heated air from the heat pump module 210 into the tub 110, and a filter module (not shown in FIGS. 1-3) that filters the air flowing into the inlet duct. The inlet duct and the outlet duct may be in fluid communication with the tub 110 through a circulation duct (not shown) and a drying duct.

The heat pump module 210 may have a module-type structure in which various parts of a heat pump are detachably connected. The heat pump module 210 may be detachably connected in the second cabinet 20. The heat pump module 210 may include an evaporator that produces a dry air by removing moisture from air, and a compressor that compresses a refrigerant that has passed through the evaporator. The heat pump module 210 may also include a condenser that heats air using heat from the refrigerant that has passed through the compressor, an expansion valve that reduces the pressure of the high-pressure refrigerant being guided into the evaporator, and a refrigerant pipe connecting the above parts.

Air that flows in through the inlet duct passes through the evaporator, and heat is absorbed by the low temperature and low pressure refrigerant in the evaporator. Moisture in the air passing through the evaporator is condensed, thereby making the air dry. Latent heat generated as the moisture in the air is condensed evaporates the refrigerant in the evaporator. The evaporated refrigerant is supplied to the compressor, compressed into a high-temperature high-pressure refrigerant by the compressor, and then supplied to the condenser. As the dried air passes through the condenser emitting the latent heat by compressing the refrigerant, the air is heated.

Accordingly, air flowing in through the inlet duct is heated and dried while passing through the evaporator and the condenser, and then is supplied to the tub 110 through the outlet duct. The air supplied to the tub 110 is guided to the drum 120 to be used for drying laundry items held therein.

In certain embodiments, the first cabinet 10 and the second cabinet 20 may form totally separated spaces 100 and 200. However, in alternative embodiments, the first and second spaces 100 and 200 may be in fluid communication with each other while being partially separated so as to accommodate various components therein. Therefore, the heat pump module 210 may be disposed only in the second space 200, or may partially extend up into the first space 100 if necessary. The second cabinet 20 may include an opening in an upper wall thereof. Portions of the heated dry air supply device disposed in the second cabinet may extend through the opening into the first space 100 defined by the first cabinet 10.

In particular, the first and second cabinets 10 and 20 may be formed a separate cabinets which may then be joined together. Providing the first and second cabinets 10 and 20 as separate cabinets which may then be joined together allows the first cabinet 10 which is configured for laundry treatment, and the second cabinet 200, which may include a heated dry air supply device, to be manufactured separately and assembled either at the manufacturing plant or at a later point. For example, the first and second cabinets 10 and 20 may be manufactured separately and then shipped to another destination for assembly. Further, a user or customer may not desire a laundry machine including the second cabinet 20 and/or the heated dry air supply device, and thus may elect to purchase only the first cabinet 10 which is configured for laundry treatment. Further, if the first and second cabinets 10 and 20 are separable, they may be separated for maintenance on one or the other.

In alternative embodiments, the tub and the drum may be mounted in a single cabinet with the heat pump module mounted at a lower part of the tub. The structures of the heat pump module and a condensed fluid drainage system (to be described later) may be structured in substantially the same manner for use in a single cabinet. More specifically, the first and second cabinets 10 and 20 may be integrally formed, or formed as a single cabinet. In such a case, the single cabinet may be divided into the first and second spaces 100 and 200 by a dividing plate or partition wall, fully or partially separating the single cabinet into main and auxiliary spaces.

Water may be supplied to the drum 120 from an external supply source through a supply valve (not shown) and used for washing of laundry. Waste wash fluid may be discharged to the tub 110 through a plurality of penetration holes formed in the drum 120. When waste wash fluid stagnates within the tub 110, an unpleasant odor may be generated, thereby deteriorating hygiene and consumer satisfaction. To this end, the wash fluid collected in an inner bottom portion of the tub 110 may be promptly drained to the outside of the tub 110 by a main drain pump 150 connected to the tub 110.

The main drain pump 150 may be provided near the lower part of the tub 110 to pump used/waste wash fluid collected at the inner bottom portion of the tub 110 toward a backflow prevention connector 130 so as to drain the waste wash fluid. The wash fluid drained from the tub 110 by the main drain pump 150 passes through a discharge hose to a backflow prevention connector 130. Next, the wash fluid is delivered to a drain hose through the backflow prevention connector 130 and is drained to the outside of the first cabinet 10.

Figure 4A:
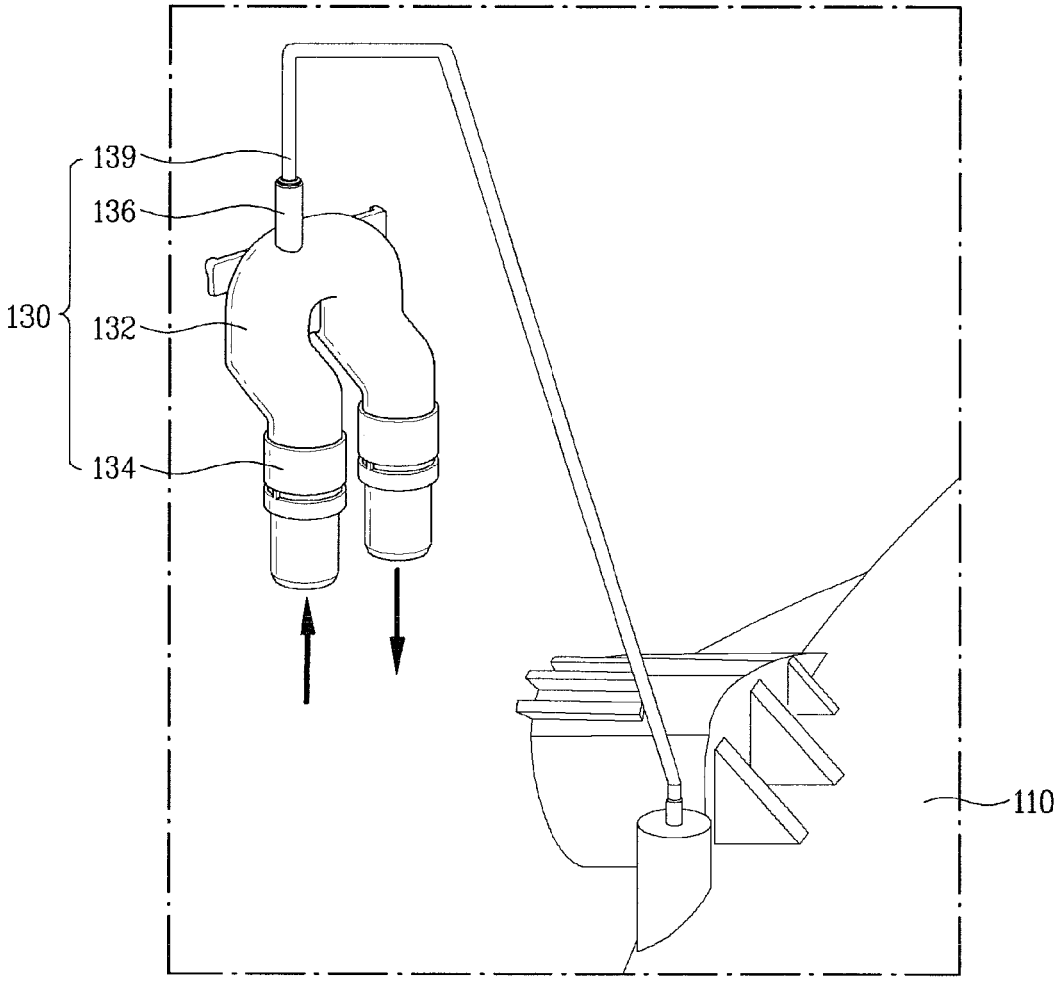
FIGS. 4A-4C illustrate an exemplary condensed water drainage systems of the washing machine shown in FIG. 1.
Figure 4B:
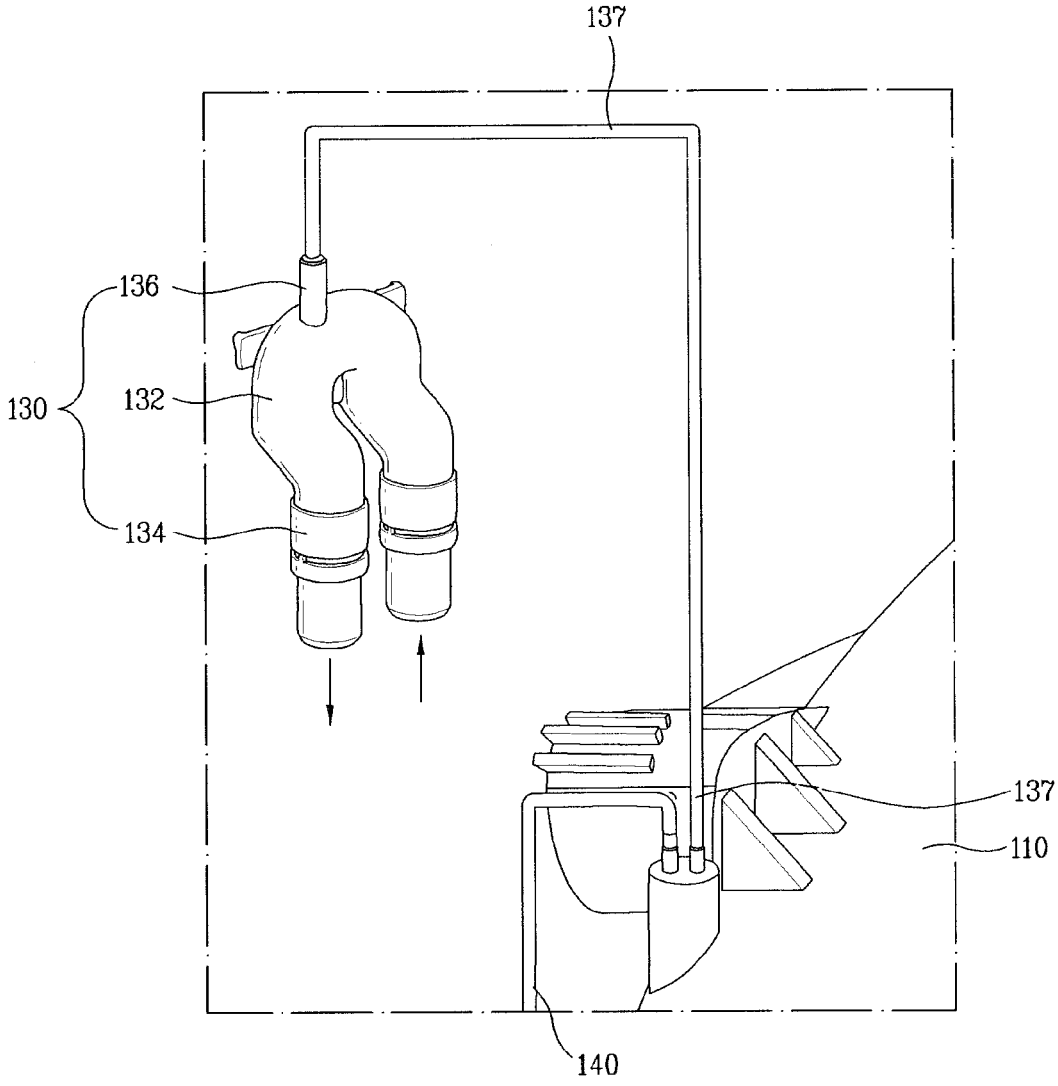
Figure 4C:
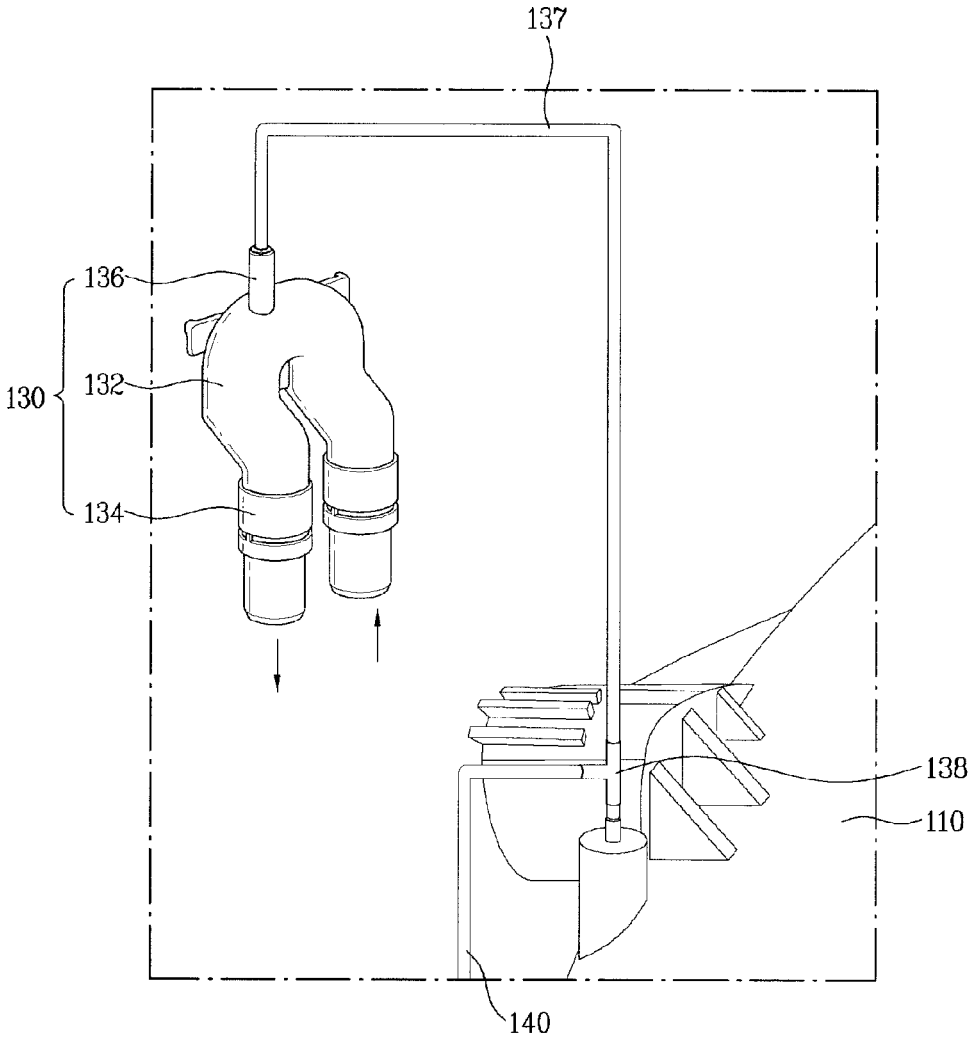

As shown in FIGS. 4A-4C, the backflow prevention connector 130 may have a U-shaped pipe form, and may be installed above the main drain pump 150 in an inverted-U position. The backflow prevention connector 130 may include a connector body 132 having an inverted-U shape installed at an upper portion of the first space 100, a pair of connection pipes 134 that extend down from the two opposite ends of the connector body 132, and an air suction guide 136 coupled to an upper portion of the connector body 132 to allow for air to flow into and out of the connector body 132. An air brake hose 137 may be connected to the air suction guide 136.

One of the connection pipes 134 may be connected with a discharge hose 130*a* which is connected with the main drain pump 150, and the other one of the connection pipes 134 may be connected with the drain hose 130*b* which discharges fluid to the outside of the first cabinet 10. The wash fluid pumped by the main drain pump 150 flows into the backflow prevention connector 130 through the discharge hose 130*a*. Next, the wash fluid flowing into the backflow prevention connector 130 is drained out of the first cabinet 10 through the drain hose 130*b*.

The air suction guide 136 may have a cylindrical form in which a siphon brake (not shown) may be inserted to prevent siphoning and backflow of the wash fluid. Alternatively, the air suction guide 136 may be equipped with the air brake hose 137 which is in turn connected with one side of the tub 110 to allow the air in the tub 110 to flow to the connector body 132. In the embodiment shown in FIGS. 4A-4C, the air brake hose 137 is employed.

The discharge hose 130*a* that connects the main drain pump 150 and the backflow prevention connector 130 may typically hold a certain amount of residual fluid due to the mounting position thereof. The residual fluid may prevent odors from the outside, for example from a sewer, from flowing into the washing machine through the drain hose 130*b*.

However, if a pressure difference occurs between the inside and the outside of the backflow prevention connector 130 while the main drain pump 150 is not in operation, the residual fluid in the discharge hose may flow back to the main drain pump 150. To this end, the siphon brake or the air brake hose 137 may be provided to prevent occurrence of such a pressure difference between the inside and the outside of the backflow prevention connector 130.

As shown in FIGS. 4A-4C, the air brake hose 137 is connected to the air suction guide 136 so as to allow passage of an airflow from the outside of the backflow prevention connector 130, that is, the air flowing to the tub 110, interrupting discharge of the fluid water from the inside of the backflow prevention connector 130. This will be more specifically explained later.

Referring back to FIG. 3, the second cabinet 20 may include a condensed fluid drain pump 220 disposed at one side therein to drain condensed fluid that has been discharged from the heat pump module 210, and a condensed fluid drain hose 140 which forms a path that guides the condensed fluid generated by the condenser in the heat pump module 210 to the backflow prevention connector 130. A first end of the condensed fluid drain hose 140 may be connected to the condensed fluid drain pump 220, and a second end may be connected to an upper portion of the tub 110. Since the main drain pump 150 may be provided even in a washing machine without such a backflow prevention connector 130, condensed fluid generated by the heat pump module 210 may be sent to the tub 110. Therefore, the condensed fluid may be discharged out of the first cabinet 10, together with the wash fluid in the tub 110.

When a predetermined amount of condensed fluid and waste wash fluid are collected at the inner bottom portion of the tub 110, the accumulated fluid may typically be drained by operating the main drain pump 150. If the main drain pump 150 is operated when the amount of accumulated fluid is too small, drainage efficiency and energy efficiency may be deteriorated. Therefore, the main drain pump 150 may instead be operated after the predetermined amount of condensed fluid and waste wash fluid has been accumulated. For this purpose, a residual fluid sensor 112 may be installed at an inner bottom portion of the tub 110 to detect the amount of fluid remaining therein. Any type of fluid level sensor generally adopted in a washing machine may be used as the residual fluid sensor 112.

As shown in FIG. 4B, a condensed fluid drain hose 140 may be connected to the air brake hose 137. One end of the air brake hose 137 may be connected to the backflow prevention connector 130 and the other end may be directly connected to the upper portion of the tub 110. According to this structure, when the condensed fluid drain hose 140 is connected to the air brake hose 137, the same effect of directly connecting the condensed fluid drain hose 140 to the tub 110 can be obtained. The condensed fluid drain hose 140 may be connected to an end of the air brake hose 137 disposed near the tub 110 so that the condensed fluid drained through the condensed fluid drain hose 140 is guided directly to the tub 110 without flowing back toward the backflow prevention connector 130.

In addition, as shown in FIG. 4C, a T-branch or Y-branch pipe 138 may be connected to the air brake hose 137 to facilitate connection of the condensed fluid drain hose 140 with the air brake hose 137. Since the condensed fluid drain hose 140 is connected to the end of the air brake hose 137 near the tub 110 through the T-branch or Y-branch pipe 138, the condensed fluid pumped up by the condensed fluid drain pump 220 and drained through the condensed fluid drain hose 140 may flow directly into the upper side of the tub 110. Accordingly, the condensed fluid is collected in the inner bottom portion of the tub 110 and may be drained out of the first cabinet 10 along with the waste wash fluid upon the operation of the main drain pump 150.

In a combined condensing-type drying and washing machine as embodied and broadly described herein, a circulation path may be provided to enable circulation of the air in the tub 110. When the air discharged from the tub 110 circulates through the circulation path, foreign substances such as dust and lint separated from the laundry may be directed towards the heat pump. This may overload the heat pump or deteriorate the performance of the heat pump. To this end, a filter assembly may be provided to filter foreign substances such as lint from the circulation path. When more than a predetermined amount of foreign substances is attached to the filter assembly, the dried may not smoothly flow through the circulation path unless the foreign substances are removed. However, it is inconvenient for the user to manually remove the foreign substances from the filter assembly. Accordingly, a filter structure as embodied and broadly described herein may automatically separate the foreign substances from the filter and discharge the foreign substances together with the wash fluid drained through the backflow prevention connector 130.

Figure 5:
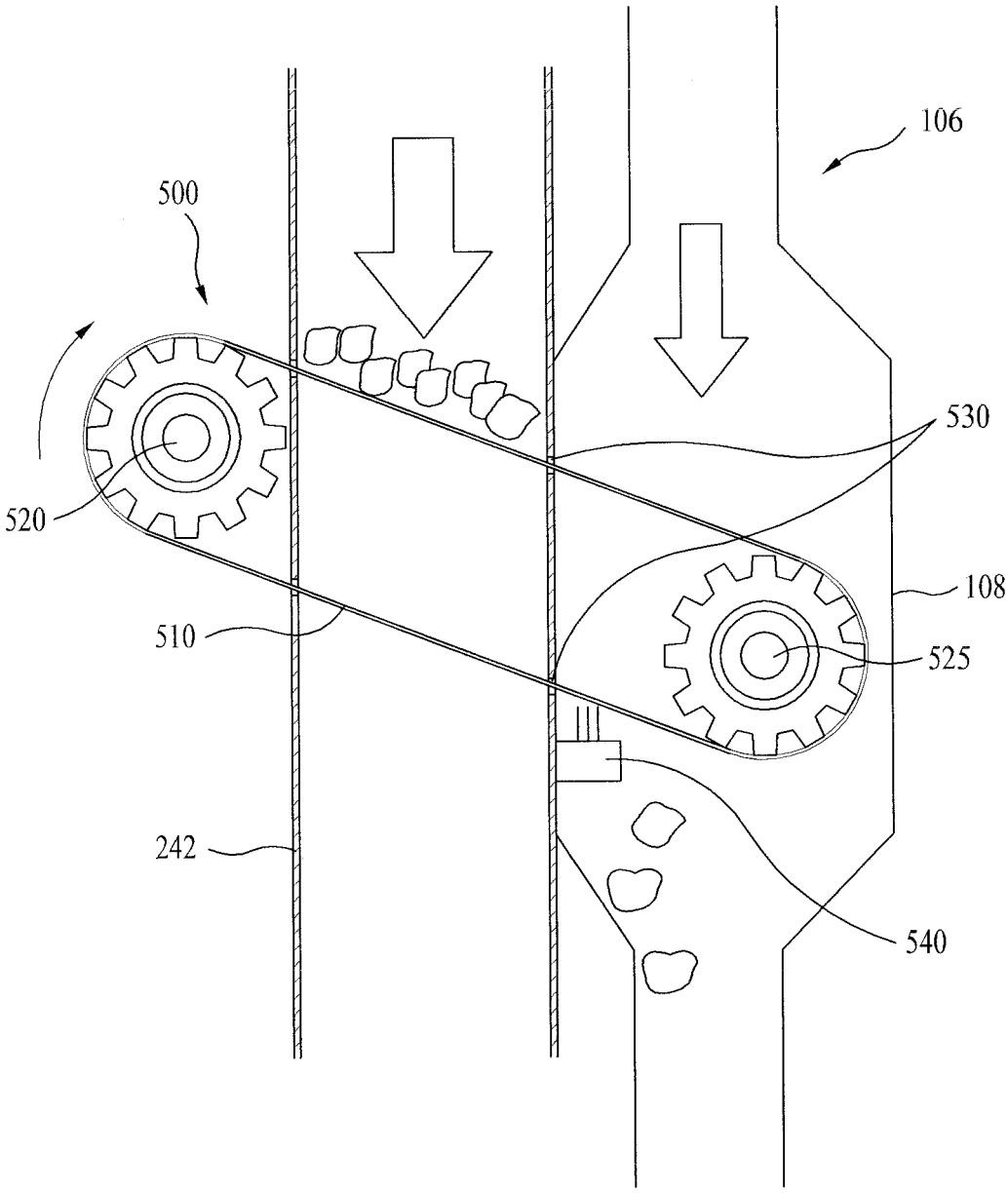
FIG. 5 illustrates a filter assembly for a washing machine according to an embodiment as broadly described herein.

FIG. 5 illustrates a filter of a washing machine according to an embodiment as broadly described herein.

As described above, the heat pump module 210 supplies dried and heated air into the tub 110 through an air supply path at an upper front part of the tub 110. After circulating through the tub 110, the air is discharged at an upper rear part of the tub 110 through an air discharge path 242. A drain path 106 (collectively including the backflow prevention connector, the discharge hose and the drain hose) extends from the lower part to the upper part of the tub 110 so as to drain the wash fluid from the inside of the tub 110.

A filter assembly 500 filters foreign substances such as lint from the air discharged from the tub 110. For example, the filter assembly 500 may be formed along the air discharge path 242, so that the air passes through the filter assembly 500 before flowing back into the heat pump module 220. Since the air discharge path 242 is disposed adjacent to the drain path 106, the foreign substances separated by the filter assembly 500 can be discharged through the drain path 106 that drains the wash fluid from the tub 110. As a result, a dedicated structure is not required to discharge the filtered foreign substances to the outside.

As shown in FIG. 5, the air discharge path 242 extends from the upper rear part of the tub 110 toward the heat pump module 220 in the second cabinet 20. If the second cabinet 20 is disposed under the first cabinet 10, the air discharge path 242 extends downward as shown in the drawing.

The drain path may extend from the lower part of the tub 110 and may be bent upward to form an inverted-U shape in order to prevent siphoning. Accordingly, at least a portion of the air discharge path 242 and the drain path 106 may be disposed adjacent to each other at the rear side of the tub 110.

In the embodiment shown in FIG. 5, the filter assembly 500 is formed at the portion of the air discharge path 242 disposed adjacent to the drain path 106 so that foreign substances removed by the filter assembly 500 may be discharged to the outside through the drain path 106 using the wash fluid flowing through the drain path 106.

The filter assembly 500 shown in FIG. 5 may include a filter member 510 that may be selectively moved between the air discharge path 242 and the drain path 106 to filter foreign substances from the air flowing through the air discharge path 242 and then remove the foreign substances using the wash fluid flowing through the drain path 106. The filter member 510 may circulate between the air discharge path 242 and the drain path 106 under the power of a circulation part including a rotating gear 520 that is rotated by a driving part, such as a motor, and a driven gear 525 that is rotated in association with rotation of the rotating gear 520.

In certain embodiments, such as, for example, the embodiment shown in FIG. 5, the filter member 510 may enclose the rotating gear 520 and the driven gear 525 so that when the rotating gear 520 is rotated by a motor, the driven gear 525 is accordingly rotated by the filter member 510. In this case, a portion of the air discharge path 242 to which the filter assembly 500 is mounted is positioned adjacent to the drain path 106. For example, the filter assembly 500 may be formed along a contacting portion between the air discharge path 242 and the drain path 106.

An opening 530 may be formed where the air discharge path 242 and the drain path 106 adjoin or contact each other, so that the filter member 510 can move through the opening 530. A single opening 530 may be provided. Alternatively, as shown in FIG. 5, a pair of openings 530 may be formed to prevent the wash fluid in the drain path 106 from entering the air discharge path 242. In this case, the openings 530 may have a shape corresponding to a sectional shape of the filter member 510, and in particular, correspond to the upper and lower portions of the filter member 510 shown in FIG. 5.

A shielding member may also be provided to prevent leakage of air from the air discharge path 242 through the opening 530 or leakage of wash fluid from the drain path 106. The shielding member would not completely cover the opening 530 but simply prevent passage of air and fluid as much as possible while still allowing for passage of the filter member 510 therethrough. For example, a flexible elastic member may be used for the shielding member.

Hereinafter, the operation of a filter assembly 500 according to an embodiment as broadly described herein will be provided.

First, air discharged from the tub 110 flows along the air discharge path 242, and foreign substances in the air are filtered by the filter member 510 and attached to an upper surface of the filter member 510. The amount of foreign substances attached to the filter member 510 increases as more air passes through the air discharge path 242. A controller (not shown) of the washing machine rotates the rotating gear 520 for a predetermined time period, for example, after a drying course is completed. The controller may be disposed in the air discharge path 242 and rotates the rotating gear 520 until a part of the filter member 510, to which the foreign substances are attached, is moved into the drain path 106. When the washing machine performs a course that drains the wash fluid, such as a rinsing course, the foreign substances attached to the filter member 510 are separated from the filter member 510 by the wash fluid flowing through the drain path 106, and are discharged through the drain path 106.

If the filter member 510 obstructs a large portion of the sectional area of the drain path 106, the wash fluid may not be effectively drained through the drain path 106. Therefore, as shown in FIG. 5, an expansion part 108 may be formed at a certain section of the drain path 106 in which the filter member 510 is positioned/moved, the expansion part 108 having a larger diameter than remaining parts of the drain path 106. The filter member 510 covers only a part of the drain path 106 at the expansion part 108 so that wash fluid may be drained efficiently through the drain path 106.

Although the filter member 510 is cleaned by the draining wash fluid, foreign substances may still remain attached to the filter member 510. To this end, a cleaning part 540 may also be provided to remove the foreign substances not separated by the wash fluid but remaining on the filter member 510.

The cleaning part 540 may be disposed at a number of positions. In the embodiment shown in FIG. 5, the cleaning part 540 is positioned along a lower one of the openings 530 to clean the filter member 510 as it moves from the drain path 106 back into the air discharge path 242. If the cleaning part 540 is positioned in the drain path 106 adjacent to the lower opening 530, foreign substances removed by the cleaning part 540 may be discharged through the drain path 106 along with the wash fluid.

When the cleaning part 540 is provided as described above, the filter member 510 is cleaned primarily by the wash fluid and then secondarily by the cleaning part 540, thus more efficiently and effectively removing foreign substances from the filter member 510.

Figure 6:
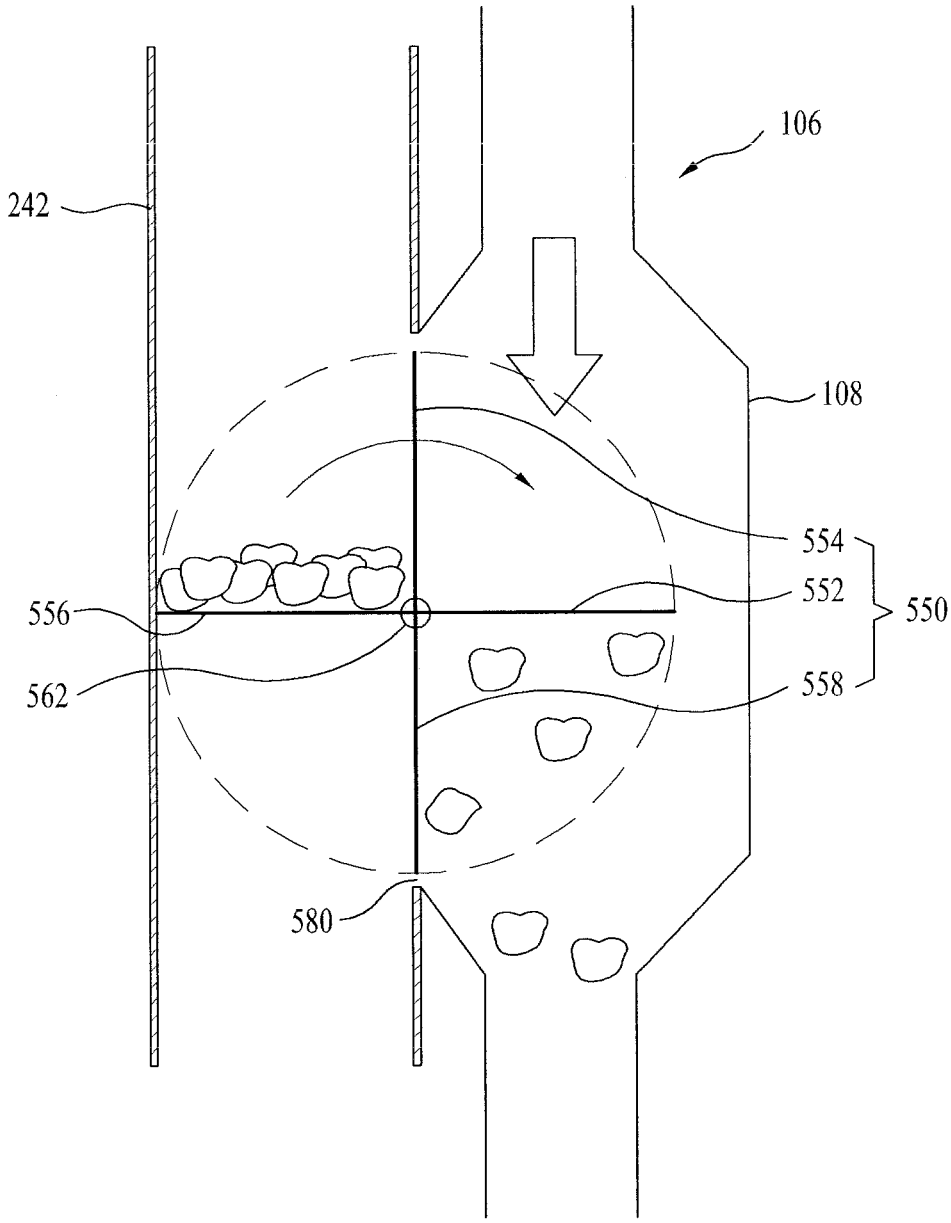
FIG. 6 illustrates a filter assembly for a washing machine according to another embodiment as broadly described herein.

FIG. 6 illustrates a filter assembly according to another embodiment as broadly described herein. Compared to the embodiment shown in FIG. 5, the filter assembly shown in FIG. 6 is distinctive in terms of a manner of moving the filter member.

The filter assembly shown in FIG. 6 may include a filter member 550 that rotates between the air discharge path 242 and the drain path 106, at corresponding portions where the air discharge path 242 and the drain path 106 adjoin each other. An opening 580 is formed at the corresponding portions where the air discharge path 242 and the drain path 106 adjoin so that the filter member 550 may be rotated in the opening 580.

The filter assembly may include a driver that rotates the filter member 550, formed along a border between the air discharge path 242 and the drain path 106. According to this structure, the filter member 550 may be rotated by the operation of the driver and thereby moved between the air discharge path 242 and the drain path 106.

The filter member 550 may extend radially about a driving shaft 562 of the driver. The number of individual filter members 550 extending from the driving shaft 562 is not specifically limited. For example, two filter members 550 or four filter members 550 may extend from the driving shaft 562. When two filter members 550 are provided, the filter members 550 may be arranged to form an angle of about 180° with each other. When four filter members 550 are provided, the filter members 550 may be in a cross arrangement to form an angle of about 90° therebetween, as shown in FIG. 6.

During operation, air discharged from the tub 110 is moved along the air discharge path 242, and foreign substances in the air are filtered by a third filter member 556 of the filter member 550. The filtered foreign substances are attached to an upper side of the third filter member 556 with respect to FIG. 6. The amount of foreign substances attached to the third filter member 556 gradually increase as more air passes through the air discharge path 242. The foreign substances attached to a first filter member 552 disposed in the drain path in FIG. 6 are cleaned/removed from the first filter member 552 by the wash fluid drained from the tub 110 and flowing through the drain path 106.

The controller of the washing machine operates the driver for a predetermined time period, for example, after every drying course. When two filter members are provided, the controller may control the driving shaft 562 of the driver to rotate by about 180°. When four filter members are provided, the driving shaft 562 of the driver may be rotated by about 90° or 180°.

When two filter members 550 are provided and the driving shaft 562 of the driver is rotated by about 180°, the filter members 550 are rotated to be disposed in the air discharge path 242 after being cleaned. On the other hand, the filter members 550 having the foreign substances are disposed in the drain path 106 so as to be cleaned.

When four filter members 550 are provided and the driving shaft 562 of the driver is rotated by about 90°, a fourth filter member 558, disposed corresponding to the border between the air discharge path 242 and the drain path 106 is disposed in the air discharge path 242. On the other hand, the third filter member 556, to which the foreign substances are attached, is rotated and then disposed corresponding to the border between the air discharge path 242 and the drain path 106. In addition, a second filter member 554 disposed corresponding to the border between the air discharge path 242 and the drain path 106 is rotated into the drain path 106, to be cleaned by the wash fluid.

Figure 7:
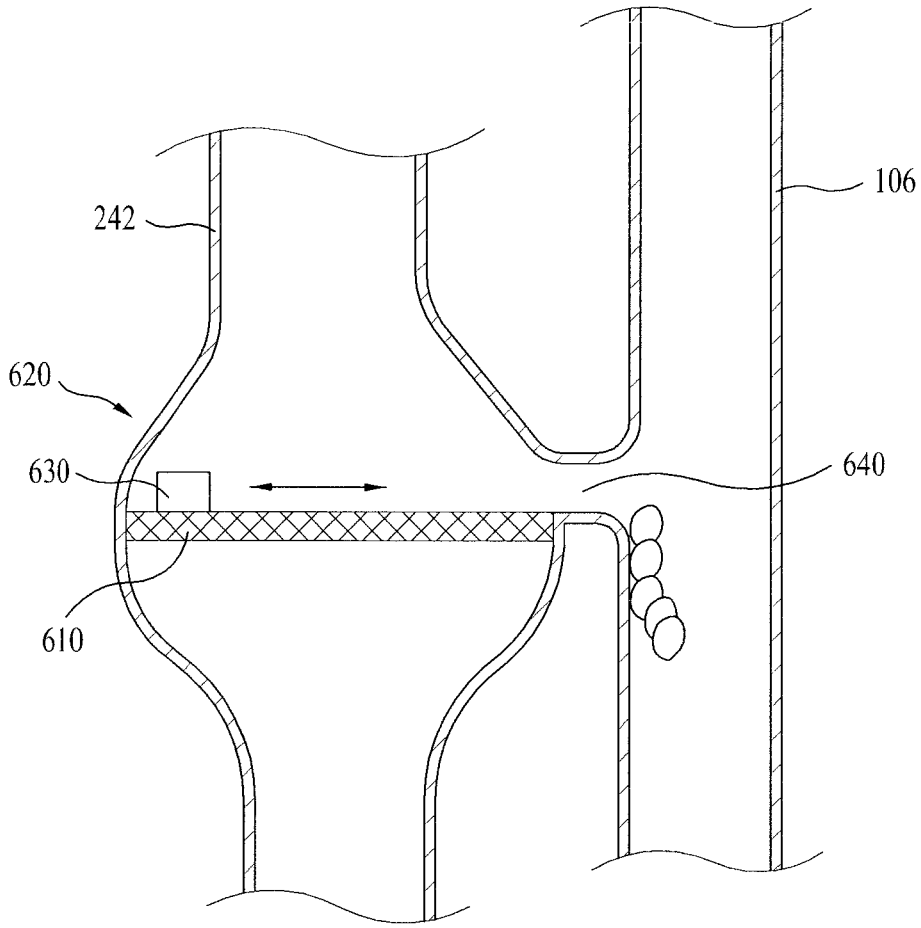
FIG. 7 illustrates a filter assembly for a washing machine according to another embodiment as broadly described herein.

FIG. 7 illustrates a filter assembly according to another embodiment as broadly described herein. This embodiment is distinctive from the previous embodiments in that it includes a removal part 620 that cleans the filter member and removes the foreign substances.

The filter assembly shown in FIG. 7 may include a filter member 610 disposed along the air discharge path 242 to filter foreign substances from air flowing therethrough, and the removal part 620 to remove foreign substances attached to the filter member 610.

The removal part 620 may include a mover 630 that moves along the filter member 610 to collect the foreign substances, and a driver that supplies a driving force for operating the mover 630.

The mover 630 moves horizontally in a reciprocating manner along an upper side of the filter member 610, thereby collecting and removing the foreign substances attached to the upper side of the filter member 610. An opening 640 may be formed at one side of the air discharge path 242, where the filter member 610 is positioned, to provide for fluid communication between the air discharge path 242 and the drain path 106.

Accordingly, when the air discharged from the tub is filtered and the foreign substances are accumulated on the upper side of the filter member 610, the controller operates the mover 630, for example, from the left to the right with respect to FIG. 7. As the mover 630 is moved to the right in FIG. 7, the foreign substances collected on the filter member 610 are separated from the filter member 630, are moved to the right by the mover 630, and are guided to the drain path 106 through the opening 640. After the foreign substances are thus removed, the controller separates the mover 630 from the opening 640, for example by moving the mover 630 to the left with respect to FIG. 7, so as to perform cleaning for the next cycle. The foreign substances guided into the drain path 106 by the mover 630 are discharged to the outside of the washing machine along with the draining wash fluid.

Although not shown, if the air discharge path 242 and the drain path 106 are positioned adjacent to each other but not in contact with each other, a foreign-substance path may also be provided to interconnect the air discharge path 242 and the drain path 106. The foreign-substance path may be in fluid communication with the opening 640 so as to guide the foreign substances flowing into the foreign-substance path through the opening 640, to the drain path 106.

Figure 8:
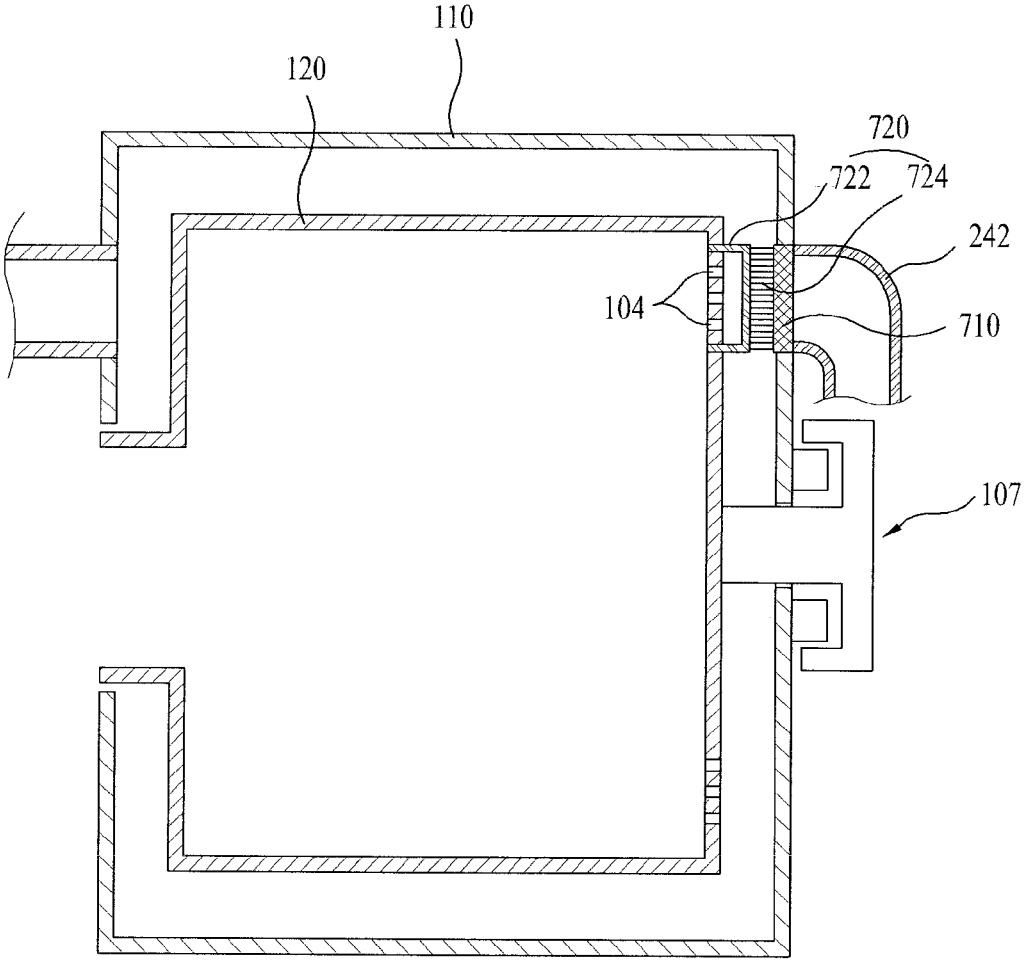
FIG. 8 illustrates a filter assembly for a washing machine according to another embodiment as broadly described herein.

FIG. 8 illustrates a filter assembly according to another embodiment as broadly described herein. This embodiment is distinctive from previous embodiments in that cleaning of the filter assembly is performed by a rotating drum shown in FIG. 9.

Figure 9:
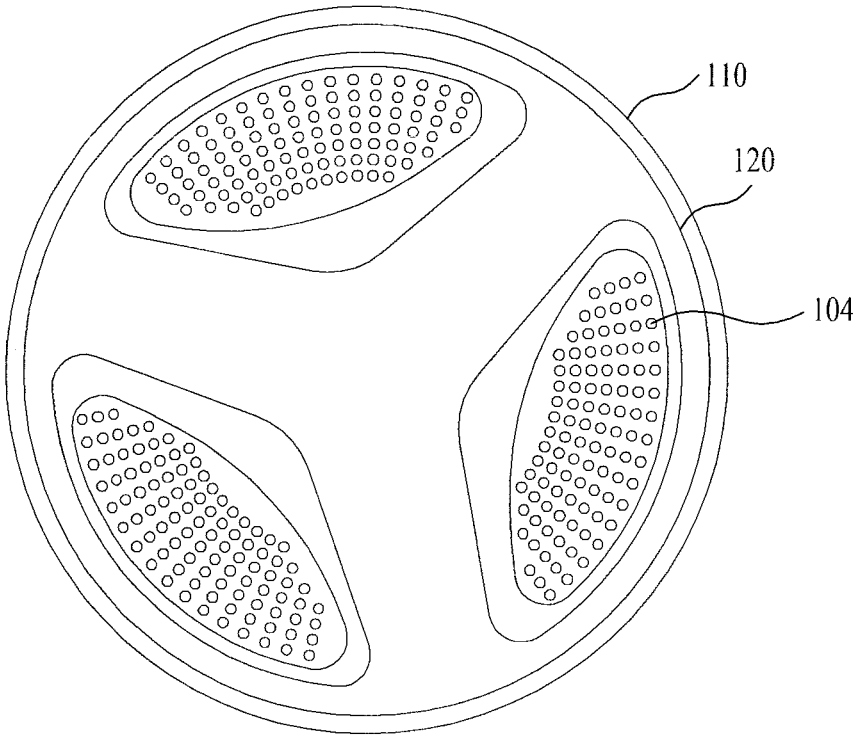
FIG. 9 is a rear view of a drum of washing machine according to an embodiment as broadly described herein.

A filter assembly as shown in FIG. 8 and FIG. 9 may include a filter member 710 formed at the tub 110 along the air discharge path 242, and a cleaning member 720 formed at the drum 120 to clean the filter member 710 according to rotation of the drum 103.

More specifically, the tub 110 may include air discharge holes 104 formed on a rear surface thereof and may provide for fluid communication with the air discharge path 242. The filter member 710 is provided at the air discharge holes 104. The filter member 710 filters foreign substances from air discharged from the tub 110 to the air discharge path 242 through the air discharge holes 104. The filtered foreign substances are attached to an inner side of the filter member 710 facing the drum 120.

The cleaning member 720 is positioned at a rear side of the drum 120 corresponding to the air discharge holes 104, in order to clean the inner side of the filter member 710 facing the drum 120. That is, the cleaning member 720 is structured to rotate so that the locus of rotation of the cleaning member 720 passes through the air discharge holes 104 when the drum 110 rotates. In other words, the cleaning member 720 is rotated in association with the rotation of the drum 110, and passes through the filter member 710 while rotating. That is, the cleaning member 720 rotates the filter member 710 according to the rotation of the drum 110.

The cleaning member 720 may include a main body 722 connected to the air discharge hole 104 formed on the rear surface of the drum 110, and a brush 724 that extends from the main body 722. A length of the brush 724 may be greater than or equal to a distance between the rear surface of the drum 103 and the tub 110, such that an end of the brush 724 can reach and clean the filter member 710.

The cleaning member 720 is capable of removing foreign substances accumulated on the filter member 710 using the brush 724 according to the rotation of the drum 110. The foreign substances separated from the filter member 710 fall to the bottom of the tub 110 and are discharged out of the washing machine through the drain path 106 along with the wash fluid. As described above, the user does not have to directly remove the foreign substances. As a result, user convenience is improved.

A washing machine is provided with a drain system capable of efficiently draining condensed water discharged from a heat pump module.

A washing machine as embodied and broadly described herein may include a first cabinet providing a first space, a tub mounted in the first space to receive wash water, a drum rotatably mounted in the tub to receive laundry, a second cabinet removably provided to the first cabinet to provide a second space, a heat pump module mounted in the second space to supply hot air into the drum, a condensed water drain pump pumping condensed water generated from the heat pump module, and a condensed water drain hose, one end of which is connected to the condensed water drain pump and the other end of which is connected to the tub, to discharge the condensed water pumped by the condensed water drain pump to the inside of the tub.

The condensed water drain hose may be connected to one side of an upper part of the tub.

The washing machine may also include a main drain pump mounted in the first space to drain wash water collected at an inner bottom of the tub.

The main drain pump may drain the condensed water flown into the tub through the condensed water drain hose, along with the wash water collected at the inner bottom of the tub.

The washing machine may also include a remaining water sensor mounted at the inner bottom of the tub to detect an amount of remaining water.

A washing machine as embodied and broadly described herein may include a first cabinet supplying a first space, a tub mounted in the first space to receive wash water, a drum rotatably mounted in the tub to receive laundry, a second cabinet removably provided to the first cabinet to supply a second space, a heat pump module mounted in the second space to supply hot air into the drum, a backflow prevention connector mounted in the first space to prevent backflow of wash water being drained from the tub, a condensed water drain pump pumping condensed water generated from the heat pump module, and a condensed water drain hose, one end of which is connected to the condensed water drain pump and the other end of which is connected to the tub, to discharge the condensed water pumped up by the condensed water drain pump to the inside of the tub.

The backflow prevention connector may include a connector body having an inverted-U shape mounted at an upper part in the first space, connection pipes bent down from both ends of the connector body so that the wash water flows in through one of the connection pipes end and discharged through the other one, and an air suction part connected with an air brake hose connected to one side of an upper part of the tub.

The condensed water drain hose may be connected to one upper side of the tub.

A T-branch or Y-branch pipe may be connected to an end of the air brake hose, the end near the tub, to connect the air brake hose with the tub.

The condensed water drain hose may be connected to the T-branch or Y-branch pipe to discharge the condensed water to the tub.

A washing machine as embodied and broadly described herein may include a cabinet constructing an external appearance thereof, a tub mounted in the cabinet to receive wash water, a drum rotatably mounted in the tub to receive laundry, a heat pump module mounted in the cabinet to supply hot air into the drum, a condensed water drain pump pumping condensed water generated from the heat pump module, and a condensed water drain hose, one end of which is connected to the condensed water drain pump and the other end of which is connected to the tub, to discharge the condensed water pumped up by the condensed water drain pump to the inside of the tub.

The condensed water drain hose may be connected to one side of an upper part of the tub.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washer/dryer, comprising:

a first cabinet that defines a first space;

a tub installed in the first space and configured to receive wash fluid therein;

a drum rotatably installed in the tub;

a second cabinet removably coupled to the first cabinet, wherein the second cabinet defines a second space;

a main pump that pumps wash fluid collected at an inner bottom portion of the tub;

a heat pump module installed in the second space and configured to supply hot air into the drum;

a condensed fluid drain pump that pumps condensed fluid generated by the heat pump module;

a backflow prevention connector installed in the first space, in fluid communication with the tub so as to prevent backflow of fluid being drained from the tub;

an air brake passage having a first end thereof coupled to the backflow prevention connector and a second end thereof coupled to an upper portion of the tub;

a drain hose that directs wash fluid pumped by the main pump to the backflow prevention connector for discharge from the washer/dryer; and a condensed fluid drain hose having a first end thereof coupled to the condensed fluid drain pump and a second end thereof coupled to the upper portion of the tub, wherein the condensed fluid drain hose directs condensed fluid pumped by the condensed fluid drain pump to an interior of the tub, and wherein the main pump drains the condensed fluid discharged into the tub by the condensed fluid drain hose together with wash fluid that has been discharged into the inner bottom portion of the tub for discharge from the washing machine.

2. The washer/dryer of claim 1, wherein the main pump is installed in the first space.

3. The washer/dryer of claim 1, further comprising:

a residual fluid sensor installed at the inner bottom portion of the tub to detect an amount of residual fluid in the tub.

4. The washing machine of claim 1, wherein the backflow prevention connector comprises:

a body having an inverted-U shape, wherein the body is installed at an upper portion the first space;

a pair of connection pipes that extend down from opposite ends of the body, wherein a first of the pair of connection pipes defines an inlet through which wash fluid flows into the backflow prevention connector, and a second of the pair of connection pipes defines an outlet through which wash fluid is discharged from the backflow prevention connector; and an air suction guide having a first end thereof coupled to the body and a second end thereof coupled to the first end of the air brake passage, the second end of the air brake passage being coupled to the tub.

5. The washing machine of claim 4, wherein the air suction guide comprises a first portion that extends into an upper portion of the body, spaced apart from the pair of connection parts, and a second portion that extends outward from the body so as to provide for connection with the first end of the air brake passage.

6. The washing machine of claim 5, wherein the air brake passage and air suction guide introduce air into and siphon air from the backflow prevention connector so as to regulate a pressure within the backflow prevention connector and prevent flow of wash fluid and condensed fluid back into the tub.

7. The washing machine of claim 4, further comprising a T-branch or Y-branch pipe that couples the second end of the air brake passage to the tub.

8. The washing machine of claim 7, wherein the condensed water fluid hose is also connected to the T-branch or Y-branch pipe so as to discharge condensed fluid into the tub.

* * * * *